US008249799B2

(12) United States Patent
Flotte et al.

(10) Patent No.: US 8,249,799 B2
(45) Date of Patent: Aug. 21, 2012

(54) METHOD AND DEVICE FOR AIDING NAVIGATION FOR AN AIRCRAFT IN RELATION TO OBSTACLES

(75) Inventors: Laurent Flotte, Aurade (FR); Nicolas Marty, Saint Sauveur (FR); Fabien Vittoz, Toulouse (FR)

(73) Assignee: Thales, Neuilly sur Seine (FR)

( * ) Notice: Subject to any disclaimer, the term of this patent is extended or adjusted under 35 U.S.C. 154(b) by 644 days.

(21) Appl. No.: 12/479,957

(22) Filed: Jun. 8, 2009

(65) Prior Publication Data

US 2010/0106419 A1 Apr. 29, 2010

(30) Foreign Application Priority Data

Jun. 10, 2008 (FR) ..... 08 03217

(51) Int. Cl.
*G06G 7/78* (2006.01)

(52) U.S. Cl. ..... 701/301; 701/9; 701/10; 340/945

(58) Field of Classification Search ..... 701/3, 7, 701/9, 10, 301; 340/946, 945
See application file for complete search history.

(56) References Cited

U.S. PATENT DOCUMENTS

| | | | | |
|---|---|---|---|---|
| 5,488,563 | A | 1/1996 | Chazelle et al. | |
| 7,346,437 | B2 | 3/2008 | Petillon et al. | |
| 7,433,781 | B2 | 10/2008 | Bitar et al. | |
| 7,493,197 | B2 | 2/2009 | Bitar et al. | |
| 2002/0080145 | A1 * | 6/2002 | Ishihara | 345/589 |
| 2003/0107499 | A1 | 6/2003 | Lepere et al. | |
| 2005/0113985 | A1 * | 5/2005 | Greene | 701/9 |
| 2007/0031007 | A1 | 2/2007 | Bitar | |
| 2007/0150117 | A1 | 6/2007 | Bitar et al. | |
| 2007/0174005 | A1 | 7/2007 | Bitar et al. | |
| 2007/0187554 | A1 | 8/2007 | Bitar et al. | |
| 2007/0219705 | A1 | 9/2007 | Bitar et al. | |
| 2007/0250223 | A1 | 10/2007 | Francois et al. | |
| 2007/0285283 | A1 | 12/2007 | Bitar et al. | |
| 2008/0046171 | A1 | 2/2008 | Bitar et al. | |
| 2008/0174454 | A1 | 7/2008 | Bitar et al. | |
| 2008/0288169 | A1 | 11/2008 | Meunier et al. | |
| 2008/0306639 | A1 | 12/2008 | Fleury et al. | |
| 2008/0306680 | A1 | 12/2008 | Marty et al. | |
| 2008/0306691 | A1 | 12/2008 | Louis et al. | |

(Continued)

FOREIGN PATENT DOCUMENTS

| | | | |
|---|---|---|---|
| EP | 565399 | B1 | 10/1993 |

(Continued)

*Primary Examiner* — Joseph Rocca
*Assistant Examiner* — Timothy Wilhelm
(74) *Attorney, Agent, or Firm* — Stroock & Stroock & Lavan LLP

(57) ABSTRACT

The invention relates to a method of presenting zones at risk for an aircraft comprising a system of databases, a processor, an anticollision device and a viewing device, wherein to display on the viewing device the zones at risk in relation to the obstacles, the processor carries out the steps of: acquiring obstacle data, the data corresponding to obstacles situated in the aircraft's close displacement zone; calculating the risk of collision with each of the obstacles of the displacement zone; calculating the limits of the zones at risk of collision in the close displacement zone, these limits representing the positions from which the anticollision device might possibly produce collision alerts in relation to the obstacles if the aircraft were to steer towards the obstacle while maintaining the instantaneous flight parameters; and displaying the limits of zones at risk.

21 Claims, 5 Drawing Sheets

U.S. PATENT DOCUMENTS

| | | | |
|---|---|---|---|
| 2008/0319671 | A1 | 12/2008 | Subelet et al. |
| 2009/0125236 | A1 | 5/2009 | Fontaine et al. |
| 2009/0132103 | A1 | 5/2009 | Marty et al. |
| 2009/0138145 | A1 | 5/2009 | Meunier et al. |
| 2009/0157241 | A1 | 6/2009 | Meunier et al. |

FOREIGN PATENT DOCUMENTS

| | | | |
|---|---|---|---|
| FR | 2853978 | A | 10/2004 |
| FR | 2893147 | A | 5/2007 |
| FR | 2898972 | A | 9/2007 |
| FR | 2905756 | A | 3/2008 |

* cited by examiner

METHOD AND DEVICE FOR AIDING NAVIGATION FOR AN AIRCRAFT IN RELATION TO OBSTACLES

CROSS-REFERENCE TO RELATED APPLICATION

The present application claims the benefit of French Application No. 08 03217, filed Jun. 10, 2008 which is hereby incorporated in its entirety.

FIELD OF THE INVENTION

The invention relates to the field of aerial navigation aids for the prevention of accidents in which an aircraft which is still maneuverable collides with an obstacle. Hereinafter, the term "obstacle" designates any non-natural obstruction present in the environment of the aircraft, and one then speaks notably of human constructions such as buildings or bridges. Moreover, the term "relief" or "terrain" designates obstructions relating to the natural environment such as mountainous zones.

Through the type of missions carried out, landing and takeoff in zones that are difficult to access, sometimes unprepared, or low-altitude flight, the helicopter, for example, is a craft that is very highly exposed to the risk of colliding with obstacles situated in its close environment. Beyond the geographical aspect, during medical evacuation operations, the use of the helicopter is very often reserved for survival emergency cases for which swiftness of action and the continuation of the mission are vital in regard to the victim to be rescued. The urgent nature of the mission and the taking of risks stemming therefrom correspondingly increase the risks of coming near to obstacles.

BACKGROUND OF THE INVENTION

The person skilled in the art is familiar with systems of TAWS type, "Terrain Awareness and Warning System". The aim of these systems is to generate an alert when the aircraft is in a dangerous situation where the operational margins are no longer complied with. TAWSs in the guise of autonomous computer or integrated with the functions of TCAS standing for "Traffic Collision Avoidance System", and WXR standing for "Weather Band X Radar", in an ISS, "Integrated Surveillance System", fulfil a primary function of terrain anticollision monitoring ("Safety Net") and are aimed at emitting audible alerts during an exceptional approach to the relief allowing the crew to react by engaging a vertical resource before it is too late. Accordingly, TAWS systems, decoupled from navigation systems, proceed in two ways. They periodically compare the theoretical trajectory that would be described by the aircraft during a resource and compare it with a section of the terrain and with the obstacles overflown obtained from a digital model of the world or local terrain embedded aboard the computer. Or else, certain TAWSs also integrate modes termed "reactive modes" which, by periodically comparing certain of the current parameters of the craft, for example the radio-altitude and the vertical speed, various charts determine whether the current situation of the aircraft is a normal situation or whether it is potentially dangerous. In the latter case, an alert, limited to a verbal message, is generated to inform the crew. The availability of a terrain model permits functions making it possible to improve the crew's situation perception. Among them, the objective of the alert lines is to delimit the terrain zones for which a TAWS alert might occur. For their part, the "Alert Areas" show the zones causing a TAWS alert.

Numerous patent documents describe this type of system. Among them may be cited patent "EP0 565399B1" describing all the basic concepts of TAWSs and patent application "US2003/0107499A1" describing a device for displaying the terrain risk zones capable of causing a TAWS alert.

The functions carried out by a TAWS are insufficient to protect a craft in relation to obstacles. The alert function of a TAWS system triggers a message destined for the crew as soon as a certain safety threshold is crossed. For the TAWS systems for which a representation of the discrepancy is provided, said representation is limited to the discrepancy with respect to the relief and does not take the obstacles into account. This representation, combined with the other information provided by the system, is difficult to interpret directly and requires thought on the part of the crew to determine the secure zones.

There also exist systems of "HELLAS" type that are able to fulfil a function of protecting against collisions between the craft and an obstacle, notably high-voltage lines, by preventing the aircraft from approaching the obstacle. They proceed by scanning the zone situated generally at the front of the craft by means of a laser beam invisible to the naked eye. The potential obstacles encountered are presented to the pilot via a cockpit display. An audio alert is optionally generated when the craft is considered to be too close to the obstacle. These systems exhibit drawbacks since they are complex and expensive and moreover do not make it possible to represent the risk zones.

SUMMARY OF THE INVENTION

The objective of the invention is to improve safety in situations where an aircraft operates with low lateral and vertical separation margins with respect to obstacles situated nearby. The aim being to present to the crew the remaining margins in relation to the zones for which the situation would become risky if the aircraft were to steer in their direction so as to allow them time to react and to adapt the trajectory of the craft.

More precisely, the invention relates to a method of presenting zones at risk for an aircraft including a system of databases, calculation means, an anticollision device and a viewing device, characterized in that, to display on the viewing device the zones at risk in relation to the obstacles, the calculation means carry out the following steps:

- Acquisition of obstacle data, the data corresponding to obstacles situated in the aircraft's close displacement zone,
- Calculation of the risk of collision with each of the obstacles of the displacement zone,
- Calculation of the limits of the zones at risk of collision in the close displacement zone, the limits of the zone at risk of collision with an obstacle are calculated for each obstacle on the basis of the position of the obstacle and these limits representing the positions from which the anti-collision device might possibly produce collision alerts in relation to the obstacles if the aircraft were to steer towards the obstacle while maintaining the instantaneous flight parameters,
- Display of the limits of zones at risk.

The invention achieves the fixed objective which is the improving of safety in situations where the aircraft operates with low lateral and vertical separation margins with respect to obstacles situated nearby and the decreasing of stress to the crew. Indeed, the crew has an aid to navigation allowing them to assess their exterior environment in relation to obstacles. They thus have a system allowing them to anticipate the actions as they approach the zones at risk and to not be taken by surprise by possible alarms in respect of rescue interventions when they have to bring the craft into the zones at risk. The limits of zones at risk represent the positions for which alerts have not yet been triggered but which might be triggered if the pilot maintains the instantaneous flight parameters of the vertical trajectory. When the aircraft is positioned ahead of these limits, with the instantaneous flight parameters of the vertical trajectory, the anticollision device does not generate any alerts. The invention makes it possible to present to the crew the remaining margins in relation to the zones for which the situation would become risky if the aircraft were to steer in their direction. The points of the zones inside the limits which are displayed at a given moment are outside of the range of the monitoring zone of the terrain anticollision device at this given moment. The positioning of the limit is calculated upstream of the obstacle as a function of a vertical avoidance trajectory tangential with an upper limit of the obstacle.

BRIEF DESCRIPTION OF THE DRAWINGS

The invention will be better understood and other advantages will become apparent on reading the nonlimiting description which follows and by virtue of the appended figures among which.

DETAILED DESCRIPTION OF PREFERRED EMBODIMENT

Figure 1:
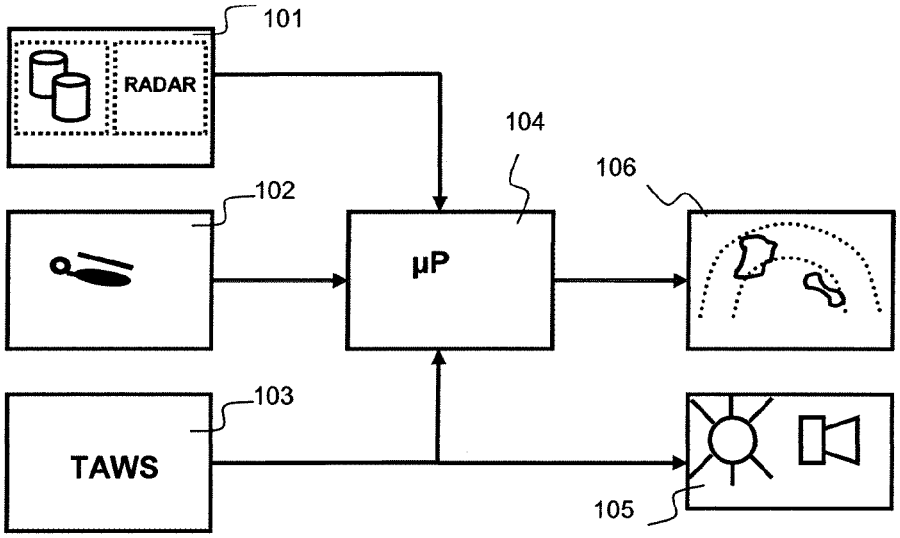
FIG. 1 represents the device making it possible to implement the method of calculating and displaying the zones at risk in relation to the obstacles.

The invention makes it possible to achieve the desired objectives by making the systems represented by FIG. 1 collaborate:

- A calculation system 104 for calculating the zones of alerts in relation to the obstacles, implementing the methods of the invention,
- A system 103 of TAWS type making it possible to raise the ad-hoc alerts 105 in the case of a dangerous approach to the relief and obstacles,
- The calculation systems 102 for calculating the aircraft flight parameters determining the state and the instantaneous behaviour of the aircraft, the performance of the aircraft as well as the operational flight margins.
- A database 101 making available the location and altitude of the surrounding obstacles. This base can be static or constructed dynamically by means of short-range or long-range radars.
- A display device 106 in the cockpit making it possible to present the information formulated by the device.

Advantageously, the device according to the invention is designed to use the obstacle databases 101, static and dynamic flight parameters 102 of the aircraft and data produced by the anticollision device 103 so as to position and to display limits of zones at risk in relation to obstacles situated in the aircraft displacement zone, these limits representing the positions from which, according to the instantaneous flight parameters of the aircraft, the anticollision device might possibly generate collision alerts 105 in relation to the obstacles. Access to the obstacle database 101 is gained directly or via a database server.

The systems 102 include the devices making it possible to obtain the flight parameters. The flight parameters are representative of the aircraft displacement conditions; the vertical speed, the speed, the angle of slope, the altitude, the location as well as the aerodynamic configuration of the aircraft may be cited for example. The systems 102 include the satellite navigation devices, the devices of inertial platform type, as well as the databases relating to the performance of the aircraft making it possible to obtain, as a function of the fill ratio of the aircraft and of the meteorology for example, the operational flight margins and the maximum performance of the aircraft.

The calculation means 104 carry out the functions making it possible to implement the method: a first function for acquiring obstacle data 101, a second function for calculating the risk of collision with the obstacles of the displacement zone, increased in altitude by a vertical margin 11, a third function for calculating the limits of the zones at risk of collision in relation to the obstacles and a fourth function for displaying the limits of zones at risk. The calculation means 104 are integrated into the existing environment of the aircraft. In a first mode of implementation, the calculation means 104 are separate from the anticollision device 103 installed so as to be able to supplement the information produced by the anticollision device. In a second mode of implementation, the calculation means 104 are integrated into the anticollision device 103 in the guise of a new functionality of the device.

The acquisition function is in charge of performing the acquisition of the various data and of preprocessing them so as to retain only the obstacles which are relevant in the short, or indeed medium term. Advantageously, the obstacles retained are those situated in a close displacement zone 31, represented by FIG. 2; the shape of this zone is substantially that of a half-disc centred on the position of the aircraft, oriented in the direction of the displacement of the aircraft and the diameter 30 of which varies according to the speed of the aircraft, according to an anticipation time and according to margins. The anticipation time can be preset or variable. Advantageously, an obstacle is an object defined in the databases by a volume of parallelepiped type including a width and a height, by location coordinates information, and optionally by identification information and by information about the accuracy of the data. Advantageously, the obstacle data originate from a device of radar type thus making it possible to construct the obstacle database dynamically. Advantageously, for the acquisition of the obstacle data, the obstacles for which data are missing are eliminated from the calculation. Indeed, a radar device may provide inaccurate data when an obstacle is situated at a distant position or when the radar signal is disturbed. In this case, the method eliminates the obstacle in question from the calculation of the risk zones.

The function for calculating the risk of collision receives from the acquisition function the list of the obstacles for which an alert zone is liable to be generated. For each of these obstacles, a calculation is performed so as to determine whether or not an alert zone should be produced as well as to position its boundary. Advantageously, the method, illustrated by FIGS. 2 and 3, for calculating the risk of collision with each of the obstacles includes the following steps:

- Extrapolation of the trajectory of the aircraft with a plurality of straight lines 42 according to the instantaneous flight parameters of the aircraft, the plurality of straight lines effecting a horizontal angular scan of the displacement zone 31 according to a predefined sampling interval 32,
- Calculation of the points of intersection between the said straight lines 42 extrapolating the trajectory of the aircraft and the obstacle 1 increased in altitude by a vertical margin 11,
- If there exists at least one point of intersection between the said straight lines and the obstacle increased in altitude by the said vertical margin, the obstacle is defined as an obstacle at risk, otherwise the obstacle is free of danger.
- Storage of the direction of each of the straight lines 42 including at least one obstacle at risk.

The extrapolated rectilinear trajectories 42 effect a horizontal scan of the close displacement zone 31 according to an angular sampling interval 32. This sampling interval is parametrizable according to the accuracy level desired. The trajectories 42 are extrapolated in the vertical space according to the instantaneous flight parameters of the aircraft, these instantaneous flight parameters not including the flight parameters characterizing the horizontal direction of the aircraft so as to extrapolate the trajectory in the direction of each of the obstacles of the displacement zone 31. This step of the method makes it possible to detect the angular directions for which one or more obstacles potentially at risk can arise if the aircraft retains its instantaneous flight parameters of the vertical trajectory. This step makes it possible to detect obstacles positioned outside of the monitoring range of the terrain anticollision device.

Advantageously, the said vertical margin 11 represents the zone in which the anticollision device produces collision alerts in relation to the obstacle. Advantageously, the said vertical margin 11 is variable over time and is dependent on the instantaneous flight parameters and is also dependent on the location of the aircraft. For example, when the aircraft, under low-speed conditions, is located at the level of an airport zone such as the roof of a hospital where the aircraft has to land, the building also being considered to be an obstacle, the vertical margin is reduced since the zone is identified as a landing zone and the anticollision device should not produce any collision alerts in the event that the obstacle is approached.

The function for calculating the risk of collision with obstacles includes in determining for each of the obstacles having to be considered whether the points 421 and 422 are located on the obstacle. These points represent the intersection between the extension of the current flight path of the aircraft, represented by the straight line 42 with the limits of the obstacle considered, the limits being the vertical straight lines positioned at a distance r from the location coordinates of the obstacle, the said distance r being the obstacle width defined in the databases. For the description of the calculations, the following values are defined in a benchmark system centred at the coordinates of instantaneous location of the aircraft at zero altitude:

| | |
|---|---|
| Altitude of the aircraft | H/C altitude |
| Distance of the obstacle with respect to the coordinates of the aircraft: | D |
| Width of the obstacle | r |
| Altitude of the obstacle | MSL |
| Vertical margin 11 | MOCD |
| Aircraft trajectory angle | FPA |
| Maximum aircraft climb angle | SVRM |

The equation of the straight line 42 is: Y=tan(FPA)*x+H/C altitude. The equation for the points 421 and 422 is therefore:

| Point | X | Y |
|---|---|---|
| 421 | D − r | Tan(FPA) * (D − r) + H/C altitude |
| 422 | D + r | Tan(FPA) * (D + r) + H/C altitude |

If at least one of the points 421 or 422 includes an ordinate lying between the obstacle altitude MSL increased by the vertical margin called MOOD, and the altitude of the terrain, then this point forms part of the obstacle, and an obstacle alert zone should be generated for the corresponding obstacle. In the converse case, the method should not generate any alert zone for the corresponding obstacle. In the case where the two points 421 and 422 include an altitude greater than the obstacle altitude MSL increased by the vertical margin 11 MOOD, there is no risk of collision. In the case where the two points 421 and 422 include an altitude less than the altitude of the terrain, the alert zone is then a terrain alert zone. The calculation and the presentation of the zones of alerts in relation to the terrain are already managed by the device 103 of TAWS type.

Advantageously, the function for calculating the limits of zones at risk includes the following steps:

- Calculation of a plurality of rectilinear trajectories of maximum climb 41 of the aircraft tangential with the end 410 that is highest and closest to the aircraft of the obstacle increased in altitude by the said vertical margin 11, each of the rectilinear trajectories 41 corresponding to each of the stored directions.
- Calculation of the points of intersection 6 between the said extrapolated trajectories 42 and the said rectilinear climb trajectories 41,
- Calculation of the positioning of the limits of the zones at risk, these limits being positioned on the said extrapolated rectilinear trajectories 42 at a safety distance 12 upstream of the intersection points 6 in the direction of the aircraft.

Advantageously, the limit of the zone at risk of collision with an obstacle is calculated for each obstacle on the basis of the position of the obstacle with the aim of saving calculation time. The point of intersection 6 between the straight line 42 and the straight line 41 is used as reference to position the boundary of the alert zone. When the angle FPA of instantaneous trajectory of the aircraft is greater than the maximum climb angle SVRM, the intersection point 6 is positioned on the point 410.

The equation of the straight line 41 is:

$$Y=\tan(SVRM)*[x-(D-r)]+MSL+MOCD.$$

The point 6 is therefore situated at X with:

$$\tan(FPA)*X+\text{altitude } H/C=\tan(SVRM)*[X-(D-r)]+MSL+MOCD.$$

$$\text{i.e. } X=[H/C \text{ altitude}(MSL+MOCD)+\tan(SVRM)*(D-r)]*1/[\tan(SVRM)-\tan(FPA)]$$

Advantageously, the aircraft includes a calculation means making it possible to identify obstacles and, for an obstacle, when the said intersection point 6 is positioned outside the close displacement zone 31, the obstacle is identified as an obstacle to be sidestepped. From the operational point of view, this signifies that the aircraft does not have the capabilities necessary to overfly the obstacle. Advantageously, the obstacles identified as an obstacle to be sidestepped are represented by symbols indicative of a danger. By way of non-limiting example, the obstacles identified as an obstacle to be sidestepped can be represented by a red colour or by different pictograms from the other obstacles on the viewing device.

Figure 4:
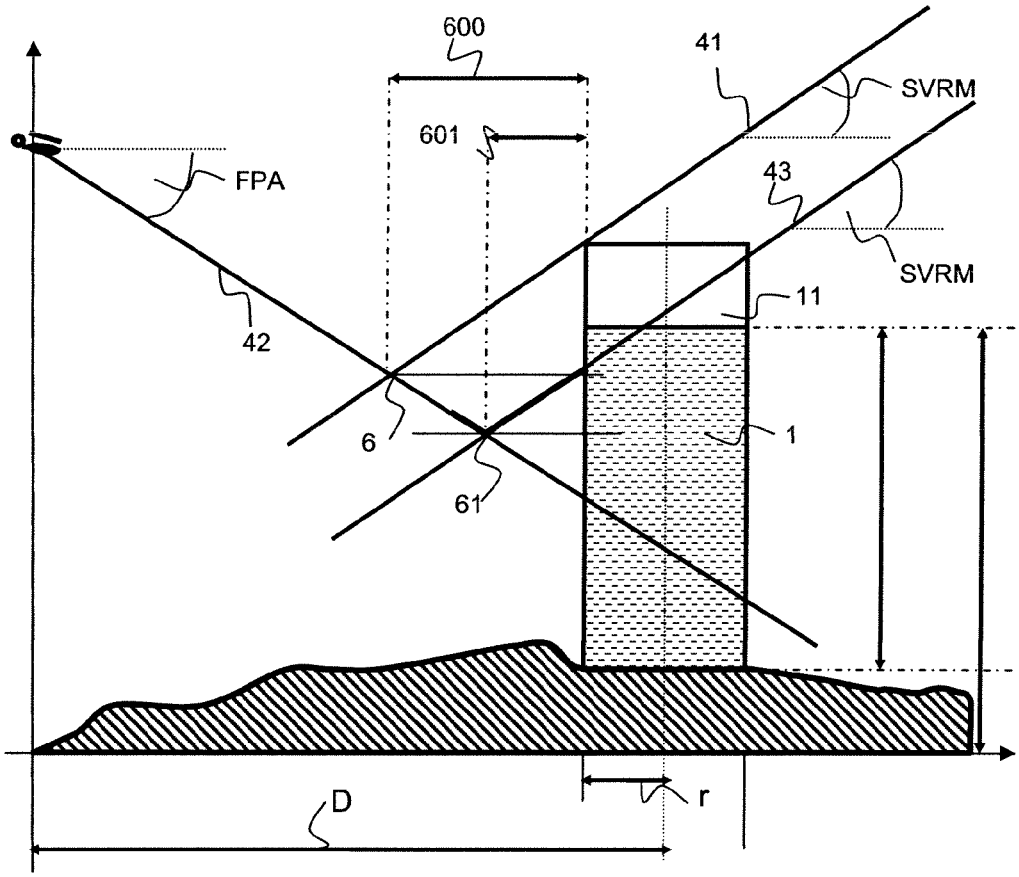
FIG. 4 represents a step of the calculation method for determining the position of the limits of zones at risk.

In the case, represented by FIG. 4, where the intersection point 6 is positioned at a distance 600, judged too high, from the point 410, a readjustment of the intersection point is necessary. Advantageously, when the distance 600 between the intersection point 6 and the closest end of the obstacle is greater than a predefined distance 601, the intersection point 61 is shifted over the said extrapolated rectilinear trajectory 42 to the said predefined distance 601 from the closest end of the obstacle, this distance 601 being the distance that the crew judges necessary to carry out a climb of a duration defined according to the maximum angle of climb. This distance therefore also depends on the performance of the aircraft. The positioning of the limit of the zone at risk is then calculated on the basis of the point 6 or of the point 61 according to the particular case.

Figure 5:
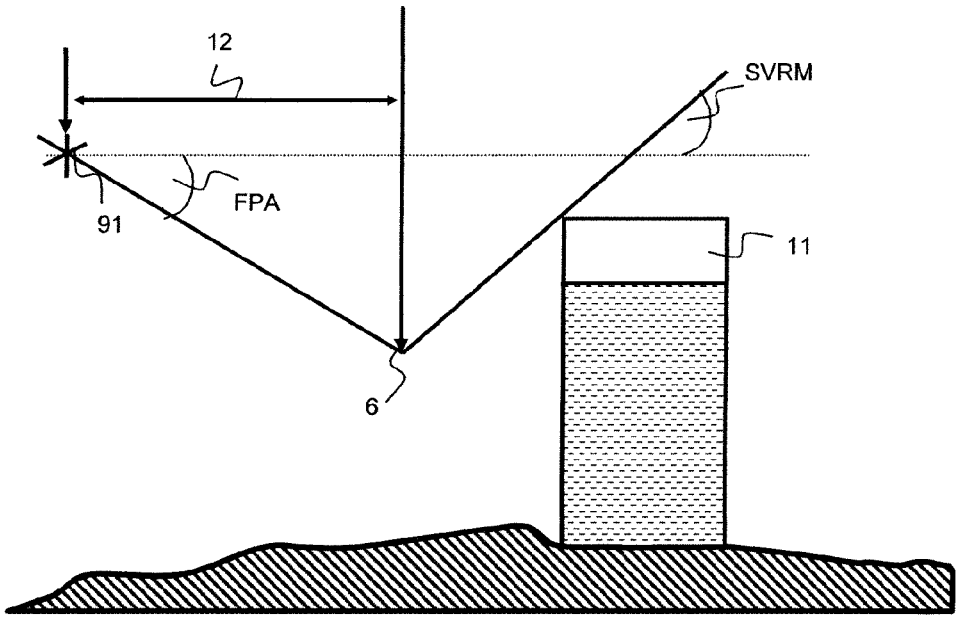
FIG. 5 represents a mode of calculation for positioning the risk zone limit according to a preset value.

In a first mode of calculation represented by FIG. 5, for each of the obstacles at risk, the limit of the zone at risk is positioned on the said extrapolated rectilinear trajectories 42 and at the said safety distance 12 which is dependent on the instantaneous speed of the aircraft and a predefined anticipation time. This anticipation time is preset and configurable by the crew.

Figure 6:
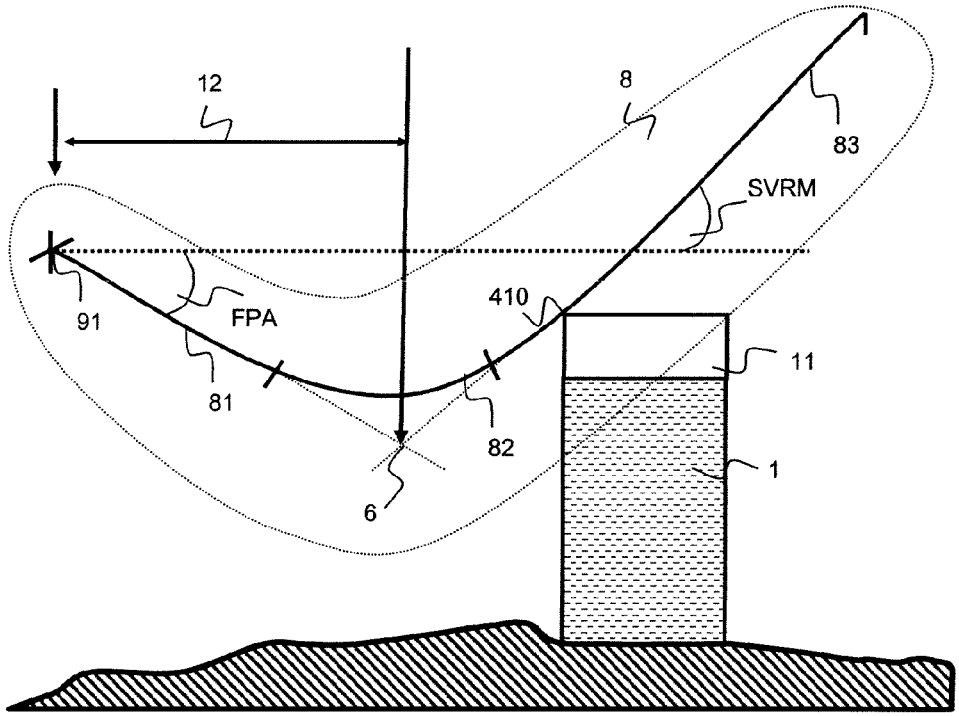
FIG. 6 represents a mode of calculation for positioning the risk zone limit on the basis of a predefined trajectory for avoiding the obstacle.

In a second mode of calculation represented by FIG. 6, the aircraft includes a means for calculating a predefined avoidance trajectory for obstacles 8 including several flight phases 81 to 83, each of the flight phases having a predefined duration, and, for each of the obstacles at risk, the said risk zone limit is positioned at a distance 12 upstream of the obstacle in such a way that the said trajectory 8 includes the climb phase tangential with the end 410 that is highest and closest to the aircraft of the obstacle increased in altitude by the said vertical margin 11. In this mode of calculation, the distance 12 corresponds to the shift necessary to reach the origin of a prober of TAWS type. For example, Shift Time=Phase Duration 81+k*Phase duration 82, with k which depends on the shape of the phase 82, the shape possibly being a circular arc, or a parabola. The distance 12 is therefore dependent on the instantaneous speed of the aircraft and the predefined time for each flight phase. The said avoidance trajectory 8 includes a first descent phase 81 of shape corresponding to the said extrapolated rectilinear trajectory, a second phase 82 of initiating a climb phase corresponding to a trajectory substantially in the shape of a circular arc centred on the said intersection point and a third phase 83 of shape corresponding to the said rectilinear climb trajectory.

The display function generates the image to be displayed by combining the data produced by the function for calculating the limits of zones at risk with external data such as the position of the obstacles, their dimension and their nature so as to represent the obstacle in correlation with reality. Advantageously, the limits 91 of the risk zones are displayed simultaneously with the terrain risk zones, the terrain alert lines originating from the TAWS device 103 as well as the terrain profile and the operational margins. Advantageously, when a substantially critical collision alert is produced, the display of the zones at risk of collision is deactivated or is adapted so as to display only the zones causing the alert, these zones possibly originating from the TAWS device 103.

Figure 2:
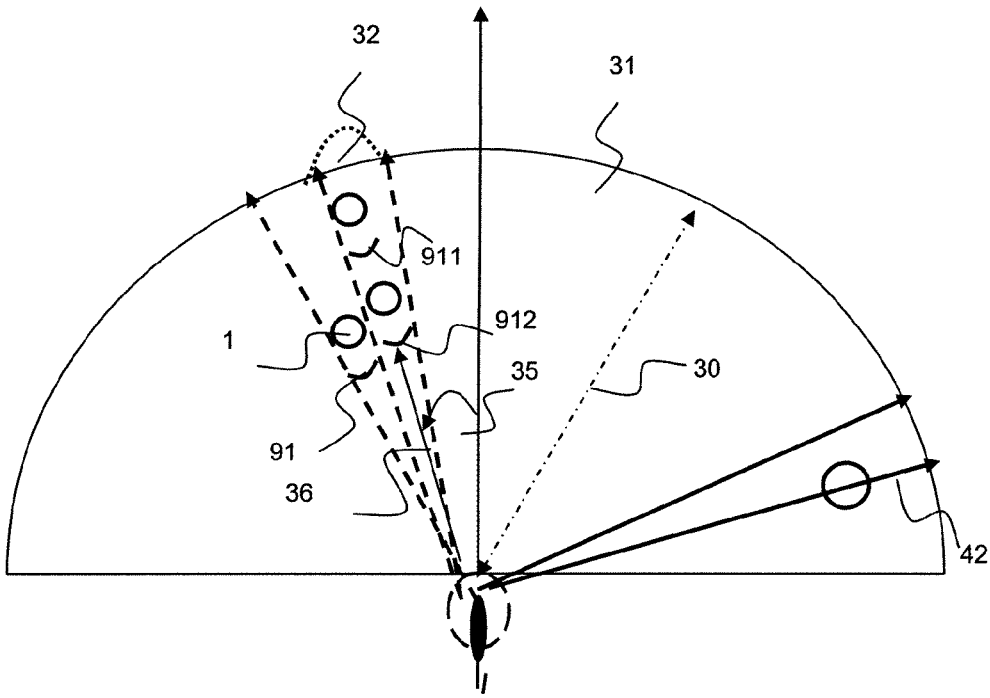
FIG. 2 represents the displacement zone in which the obstacles to be monitored are extracted.
Figure 3:
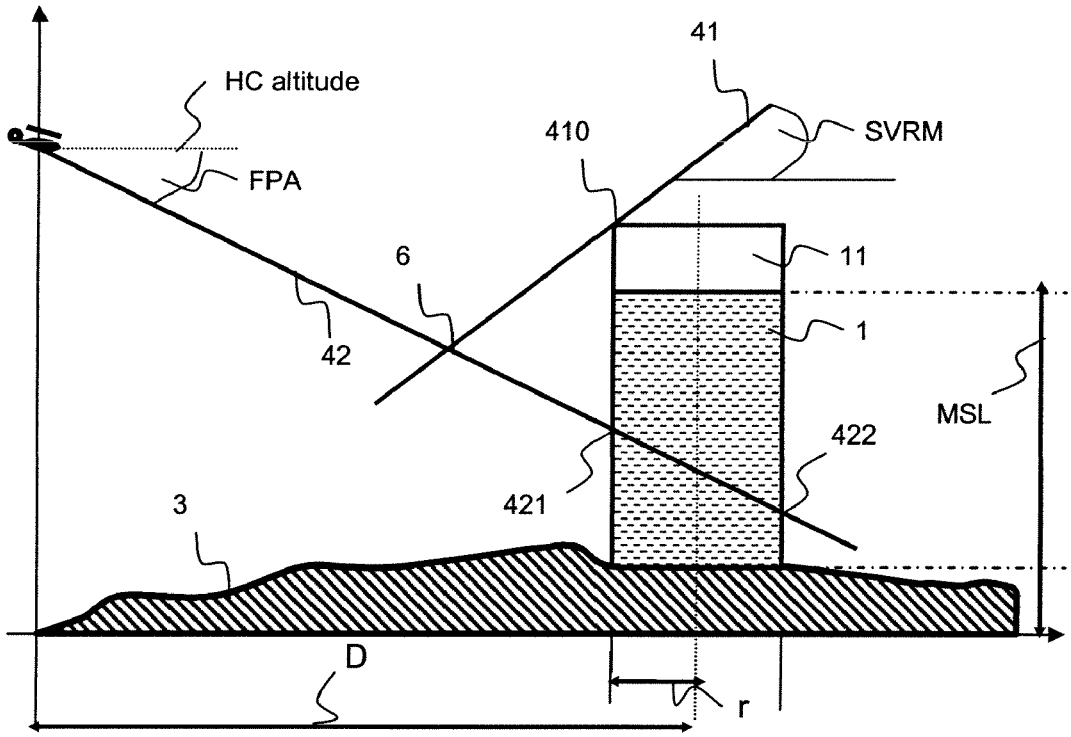
FIG. 3 represents a step of the calculation method for determining the position of the limits of zones at risk.

For the display, the displacement zone is divided into radials according to an angular sampling interval. These radials represent sectors of the displacement zone along a direction 35 with respect to the instantaneous direction of the aircraft and the angle of spread of the sector 32. The limit of the zone at risk in relation to an obstacle is then defined by a pair of parameters so as to be located in the displacement zone. These parameters, represented in FIG. 2, are the direction 35 and a distance 36 between the aircraft and the limit of the risk zone.

Figure 7A:
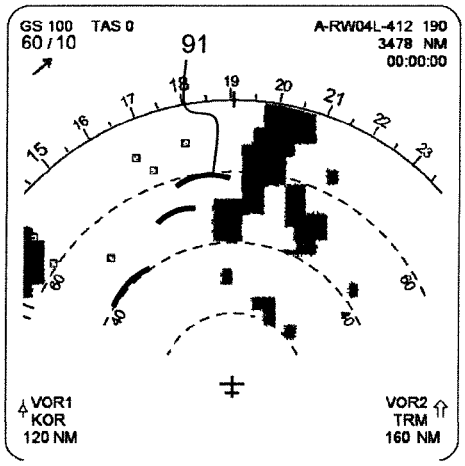
FIGS. 7*a*, 7*b* and 7*c* represent three modes of implementation for the display of the limits of zones at risk.
Figure 7B:
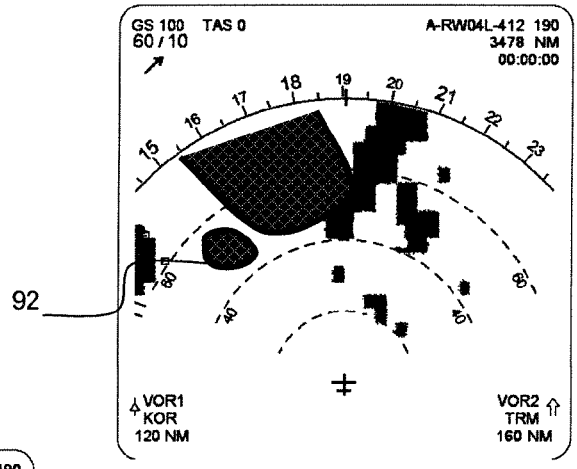
Figure 7C:
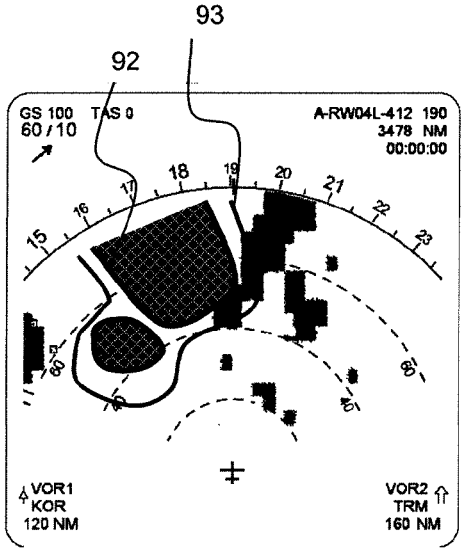

According to the cockpit philosophy chosen, represented by FIGS. 7*a*, 7*b* and 7*c*, the risk zones are identified by solid shapes 92, represented in FIG. 7*b*, distinct from the terrain data indications so as to allow the crew to properly distinguish between the zones that might generate alerts and the risk-free zones towards which the aircraft can steer. They may also be symbolized by zones of colours. In another mode of representation described by FIG. 7*c*, the operational flight margins 93 of the aircraft are displayed around the limits of zones at risk 92. In another mode of representation described by FIG. 7*a*, the risk zones can also be delimited by their boundaries by symbols 91 substantially in the shape of a polygonal line. Advantageously, in this mode of representation only the limit of the risk zone closest to the aircraft for each of the stored directions 35 is displayed. For example, for the limits of zones at risk 911 and 912, represented in FIG. 2 and located on the same radial, only the limit 912 is displayed.

The invention applies to navigation aid systems for aircraft and particularly to anticollision systems. The method has the advantage of reusing the same logic schemes for calculating the risk zones as the terrain anticollision device for the positioning of the limit of the risk zone as a function of a height-wise obstacle avoidance trajectory. The information displayed is thus consistent with the logic calculation schemes of the already existing devices. The method is integrated directly into the existing systems as a new functionality or into a dedicated system connected to the systems already in place aboard the aircraft.

The invention claimed is:

1. A method of presenting zones at risk of collision with an aircraft, by use of a system of databases, a processor, an anticollision device and a viewing device, wherein, to display on the viewing device the zones at risk in relation to obstacles, the processor configured to carry out the steps of:

acquiring obstacle data, the obstacle data corresponding to obstacles situated in a close displacement zone of the aircraft;

calculating a risk of collision with each of the obstacles situated in the close displacement zone;

calculating limits of the zones at risk of collision in the close displacement zone for each obstacle, based on a position of the obstacle, wherein the limits of the zones at risk of collision represent positions from which the anticollision device would produce collision alerts in relation to the obstacles if the aircraft were to steer towards the obstacle while maintaining instantaneous flight parameters; and displaying the limits of zones at risk of collision;

wherein the step of calculating the risk of collision with each of the obstacles further comprises the steps of:

extrapolating a trajectory of the aircraft with a plurality of straight lines in accord with one or more instantaneous flight parameters of the aircraft to produce extrapolated rectilinear trajectories, the plurality of straight lines effecting a horizontal angular scan of the close displacement zone according to a predefined sampling interval;

calculating points of intersection between the plurality of straight lines extrapolating the trajectory of the aircraft and the obstacle increased in altitude by a vertical margin;

declaring the obstacle as an obstacle at risk if there exists at least one point of intersection between the plurality of straight lines and the obstacle increased in altitude by the vertical margin, otherwise declaring the obstacle is free of danger; and storing a direction of each of the straight lines that include at least one obstacle at risk.

2. The method according to claim 1, wherein the step of calculating limits of the zones at risk of collision further comprises the steps of:

calculating a plurality of rectilinear trajectories of maximum climb of an aircraft tangential with an end of the obstacle that is highest and closest to the aircraft, increased in altitude by the vertical margin, wherein each of the rectilinear trajectories corresponds to each of the stored directions;

calculating points of intersection between the extrapolated rectilinear trajectories and the rectilinear trajectories of maximum climb; and calculating the position of the limits of the zones at risk, these limits being positioned on the extrapolated rectilinear trajectories at a safety distance upstream of the point of intersection in a direction of the aircraft.

3. The method according to claim 2, wherein the aircraft comprises a processor to identify obstacles, and further to identify obstacles to be sidestepped if the point of intersection of the obstacle is positioned outside the close displacement zone.

4. The method according to claim 3, wherein the obstacles identified as an obstacle to be sidestepped are represented by symbols indicative of a danger.

5. The method according to claim 2, wherein, when the distance between the point of intersection and a closest end of the obstacle is greater than a predefined distance, the point of intersection is shifted over the extrapolated rectilinear trajectory to the predefined distance from the closest end of the obstacle.

6. The method according to claim 5, wherein, for each of the obstacles at risk, the limit of the zone at risk is positioned on the extrapolated rectilinear trajectories and at the safety distance which is dependent on an instantaneous speed of the aircraft and a predefined anticipation time.

7. The method according to claim 5, wherein the aircraft comprises a processor to calculate a predefined avoidance trajectory for obstacles, the avoidance trajectory comprising several flight phases, each of the flight phases having a predefined duration, and wherein for each of the obstacles at risk, the risk zone limit is positioned at a distance upstream of the obstacle such that the avoidance trajectory comprises a climb phase that is tangential with the end of the obstacle that is highest and closest to the aircraft, the end of the obstacle increased in altitude by the vertical margin.

8. The method according to claim 7, wherein the step of displaying the limits of zones at risk further comprises identifying the risk zones by solid shapes distinct from the terrain data indications.

9. The method according to claim 8, further comprising the step of displaying the operational flight margins of the aircraft around the limits of zones at risk.

10. The method according to claim 7, wherein the step of displaying the limits of zones at risk further comprises delimiting risk zones by symbols substantially in a shape of a polygonal line.

11. The method according to claim 10, wherein only the limit of a risk zone closest to the aircraft for each of the stored directions is displayed.

12. The method according to claim 1, wherein a shape of the close displacement zone comprises a substantially half-disc centered on the position of the aircraft, oriented in a direction of a displacement of the aircraft, the half-disc having a diameter that varies in accordance with a speed of the aircraft, an anticipation time, and operational margins.

13. The method according to claim 1, wherein the vertical margin represents a zone in which the anticollision device produces collision alerts in relation to the obstacle.

14. The method according to claim 13, wherein the vertical margin is variable over time and is dependent on the instantaneous flight parameters.

15. The method according to claim 14, wherein the vertical margin is variable over time and is dependent on the location of the aircraft.

16. The method according to claim 1, wherein the limits of the risk zones are displayed substantially simultaneously with the terrain risk zones.

17. The method according to claim 1, wherein the obstacle data originate from a device of radar type.

18. The method according to claim 17, wherein the step of acquiring obstacle data further comprises the step of eliminating from the calculation obstacles for which data are missing.

19. The method according to claim 1, wherein a volume of an obstacle in the databases comprises a parallelepiped volume having a width and a height and by location coordinates information.

20. The method according to claim 19, wherein an obstacle in the databases is identified by identification information and by information about an accuracy of the data.

21. A method of presenting zones at risk of collision with an aircraft, by use of a system of databases, a processor, an anticollision device and a viewing device, wherein, to display on the viewing device the zones at risk in relation to obstacles, the processor configured to carry out the steps of:

acquiring obstacle data, the obstacle data corresponding to obstacles situated in a close displacement zone of the aircraft;

calculating a risk of collision with each of the obstacles situated in the close displacement zone;

calculating limits of the zones at risk of collision in the close displacement zone for each obstacle, based on a position of the obstacle, wherein the limits of the zones at risk of collision represent positions from which the anticollision device would produce collision alerts in relation to the obstacles if the aircraft were to steer towards the obstacle while maintaining instantaneous flight parameters;

displaying the limits of zones at risk of collision; and deactivating the display of the zones at risk of collision when a substantially critical collision alert is produced.

* * * * *